United States Patent [19]

Hsu

[11] Patent Number: 5,050,247

[45] Date of Patent: Sep. 24, 1991

[54] DRAIN VALVE AND LIFT ROD CONNECTION

[76] Inventor: Frederick D. Hsu, No. 1, Alley 1, Lane 134, An Ping Rd., Chung-Ho,, Taipei Hsien, Taiwan

[21] Appl. No.: 499,683

[22] Filed: Mar. 27, 1990

[51] Int. Cl.[5] ..... E03C 1/22; E03C 1/24

[52] U.S. Cl. ..... 4/203; 4/194

[58] Field of Search ..... 4/198, 200, 203, 293, 4/295, 202, 194, 286, 287, 275, 201, 204, 288, 289, 292; 137/625.33; 251/333

[56] References Cited

U.S. PATENT DOCUMENTS

| | | | |
|---|---|---|---|
| 176,907 | 5/1876 | Webb | 4/293 |
| 3,010,118 | 1/1960 | Isherwood | 4/203 |

*Primary Examiner*—Henry J. Recla
*Assistant Examiner*—David J. Walczak
*Attorney, Agent, or Firm*—Fleit, Jacobson, Cohn, Price, Holman & Stern

[57] ABSTRACT

A drain valve and lift rod device comprises a drain hole screen or filter (10) at the lowest portion of a lavatory (20), a plug (30) disposed below the top of the drain hole screen removably inserted into the drain holes (11), a lift rod (40) engaged with the plug and extending downwardly therefrom, and a control bar (50) for operating the left rod through a pivotable actuating rod (60). When the control bar is lowered, the plug is moved upward to be inserted fully into the drain holes; and when the control bar is moved upwardly, the plug is moved downwardly and removed from the valve closing position in the drain holes. The drain holes are a plurality of tapered or conical circular cross-section openings (11) and the plug has a plurality of similarly shaped stems (31) which when inserted fully into the circular openings, respectively, prevent water contained in the lavatory from draining.

13 Claims, 5 Drawing Sheets

DRAIN VALVE AND LIFT ROD CONNECTION

BACKGROUND OF THE INVENTION

Drain valves are used in lavatories in order to release the water contained therein. A conventional drain valve comprises a drain hole which is a circular hole and a plug removably received in the drain hole. To control the release of the plug, a lift rod is connected with the plug and a control bar operates the lift rod. As disclosed in U.S. Pat. No. 3,453,667, the control bar can be forced down to lift the plug out of the drain hole. When using the drain valve, its normal position is in lower or downward position for containing water in the bowl in which the valve is installed. Due to gravity, the normal position of the control bar is in the lower condition. However this is contrary to the requirement of the plug. For a conventional drain plug, the plug upwardly protrudes from the drain hole. This is inconvenient for the uses when he used the water contained in the lavatory or cleans the lavatory. It is also difficult to clean the drain hole because of the obstacle of the plug. There is no filter formed in the drain hole, so that it is possible to drain waste through the drain hole to a drain pipe.

BRIEF SUMMARY OF THE INVENTION

It is a main objective of the present invention to provide a drain valve and lift rod combination in order to overcome the disadvantages and drawbacks of conventional drain valves.

A further objective of the present invention is to provide a drain valve which comprises a plug received in a drain hole screen wherein the plug is disposed below the upper surface of the drain hole screen so that the plug is moved upwardly when inserted into the drain hole screen and downwardly when opening the drain holes therein. Therefore, the plug will not obstruct the use of the lavatory.

Another objective of the present invention is to provide a drain valve and lift rod device, wherein the plug comprises a plurality of tapered, or conical, stems and the drain holes comprise a plurality of tapered or conical circular cross-section openings, so that the tapered stems are inserted into respective circular openings to close the valve and store water in the lavatory. Therefore, the drain hole screen can be any suitable configuration and shape in order to beautify the appearance of the drain hole. The drain hole screen has a plurality of circular openings to form a filter which prevents large objects from draining through the valve.

A further objective of the present invention is to provide a drain valve and lift rod device, wherein a control bar is forced down to lift the plug upward to insert the plug into the drain holes. Therefore, when the control bar is in its normal position, that is in the lowered position, the plug is inserted into the drain holes also in the normal position, and, the operation of the control bar is much easier than a conventional control bar.

BRIEF DESCRIPTION OF THE DRAWINGS

The invention will now be described with reference to the accompanying drawings wherein.

DETAILED DESCRIPTION OF THE INVENTION

Figure 1:
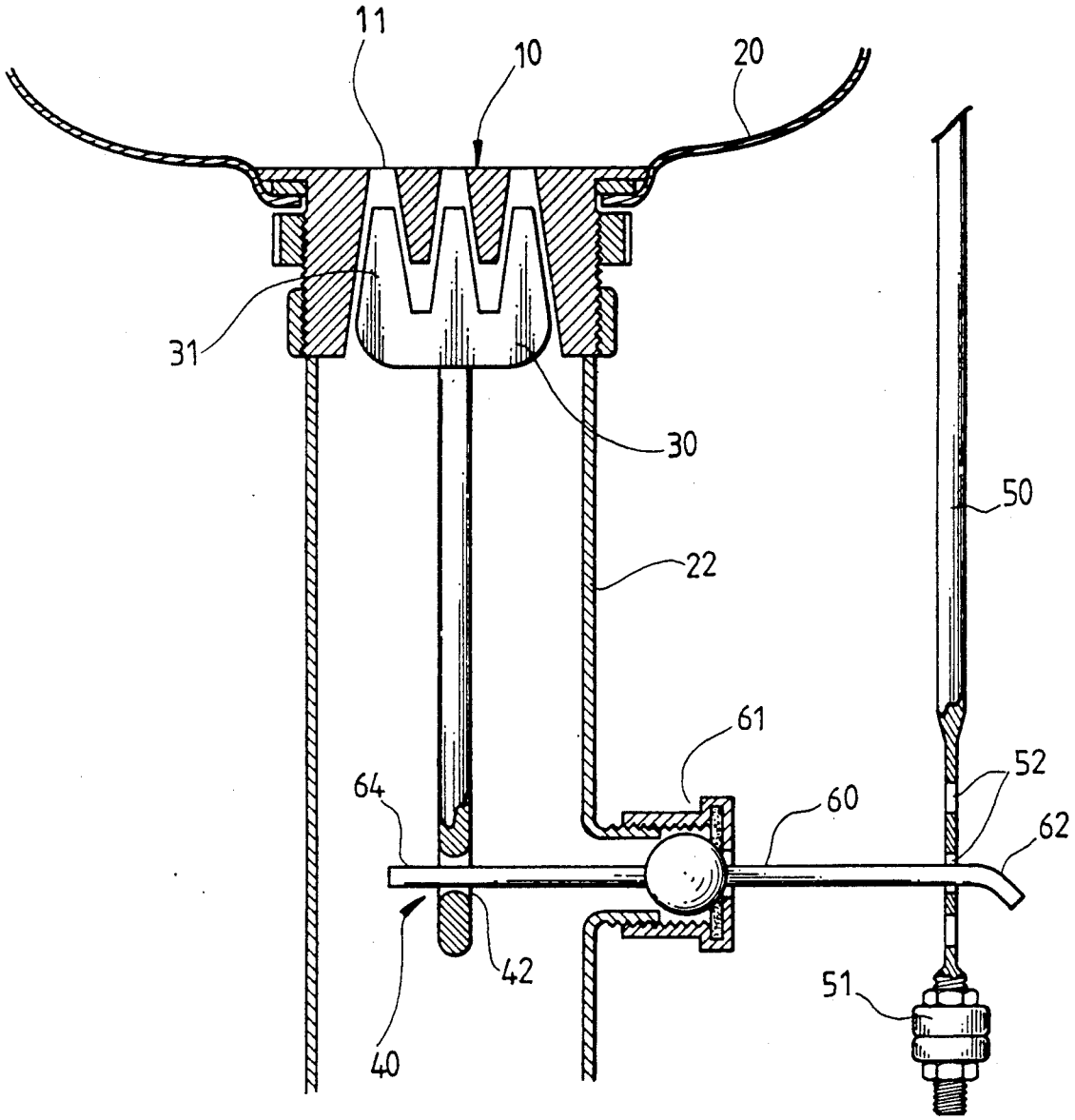
FIG. 1 is a cross-sectional view of the present invention.
Figure 2:
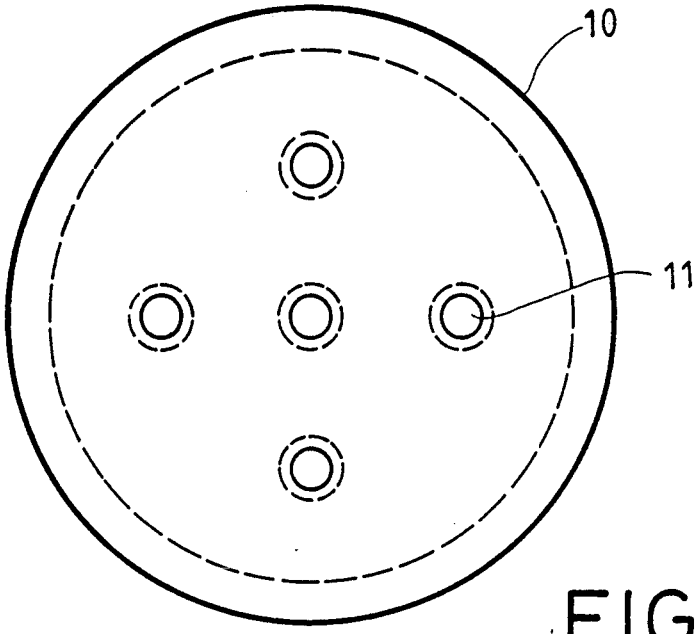
FIG. 2 is a top plan view of the drain in the present invention.

Referring to FIGS. 1 and 2, a drain valve and lift rod device of the present invention comprises a drain hole screen or filter 10 in the lowest portion or drain hole of a lavatory 20, a plug 30 removeably received in the drain holes 11 of screen 10 and disposed below the top surface there of, a lift rod 40 downwardly extending from and engaged with the plug 30, actuating rod 60 pivotally connected at one end to the lower end of rod 40, and a control bar 50 pivotally engaging with the other end of rod 60. A weight 51 is disposed at the lower end of the control bar 50 to adjust and balance the force of the control bar 50 and the lift rod 40. When forcing the control bar 50 downward, the lift rod 40 will move the plug 30 upward and insert the plug 30 into the drain holes 11 to store water in the lavatory 20 for use.

Figure 8:
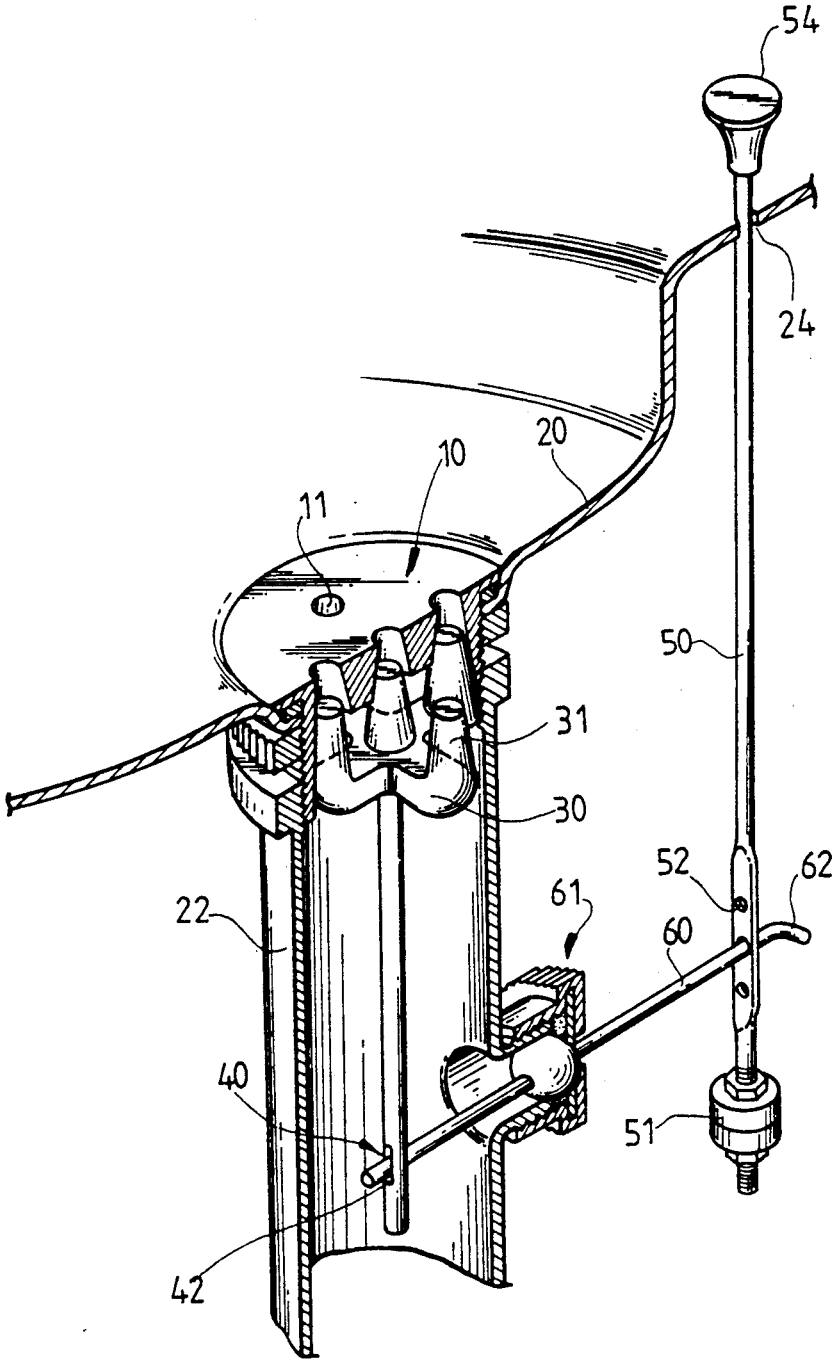
FIG. 8 is a perspective cross-sectional view of the invention.

Actuating rod 60 is pivotally connected in a conventional manner as shown generally at 61 in FIG. 1 and has one end 62 inserted loosely through one of adjusting holes 52 in rod 50 and the other end 64 inserted loosely through hole 42 in rod 40, so that upward and downward movement of rod 50 pivots rod 60 about pivotal connection 61 to lower and raise 40, respectively, to control opening and closely, respectively, of the drain valve. These structural features and manner of use are more clearly shown in FIG. 8 which also shows the manner in which the upper end of control bar 40 extends through hole 24 in the lavatory or bowl 20 and has a knob or handle 54 thereon.

It is obvious that the plug 30 is disposed below the upper surface of drain hole screen 10, so that there is no obstacle when using water contained in the lavatory 20 or cleaning the lavatory 20. Due to gravity, the normal position of the control bar 50 is in the lower or downward position. When the control bar 50 is lowered down, the plug 30 is moved upward and inserted into drain holes 11, that is the normal positions of the control bar 50 and the plug 30 are opposite.

The plug 30 when either being inserted into or removed from drain holes 11 will not obstruct the inner space of the lavatory 20 for use. Therefore, it is convenient for the user to wash any article in the lavatory 20 and clean the lavatory 20.

Figure 4:
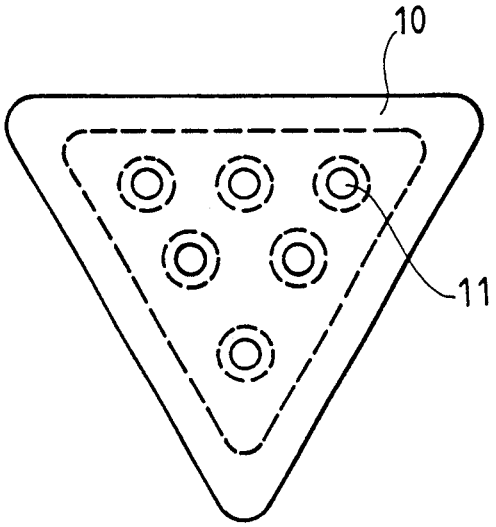
FIGS. 4 and 5 are top plan views showing various shapes of drain hole screens of various embodiments of the present invention.
Figure 5:
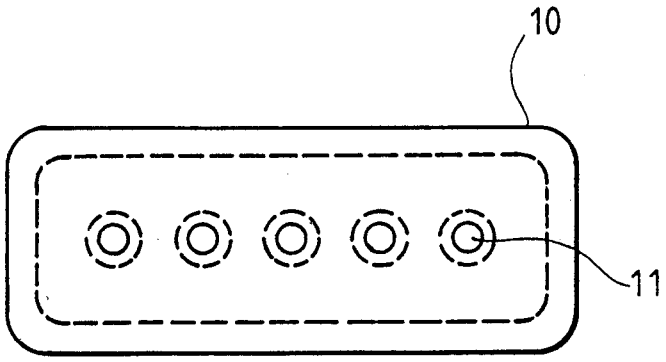

The drain holes 11 comprise a plurality of circular openings and the plug 30 comprises a plurality of tapered or conical stems having a circular cross-section 31 inserted into respective circular cross-section tapered or conical openings 11 to prevent water from draining from the lavatory 20. Since the drain hole screen 10 is formed of a plurality of the circular openings 11, the drain hole screen 10 is a filter to prevent objects larger than the holes from draining therethrough. It is not necessary to further provide a filter because the drain hole screen 10 is a filter. Therefore, the drain hole screen 10 can be formed in various shapes, as shown in FIGS. 4 and 5, to beautify the appearance of the drain hole 10.

Figure 6:
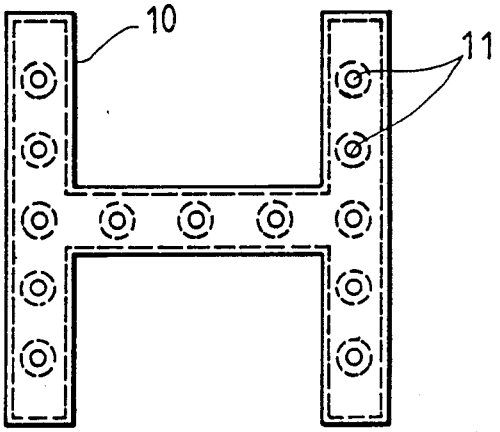
FIG. 6 is a top plan view showing an H-shaped drain hole screen of the present invention.
Figure 7:
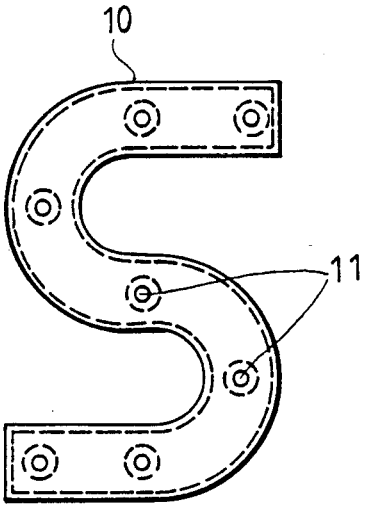
FIG. 7 is a top plan view showing an S-shaped drain hole screen of the present invention.

FIGS. 6 and 7 show various embodiments of the present invention, wherein the drain hole screen 10 can be formed in "H" or "S" shapes and the plug 30 (not shown) has similar shapes, respectively, for insertion into drain holes 11. It is obvious that the appearance of the drain hole 10 can be modified by those skilled in the art.

Figure 3:
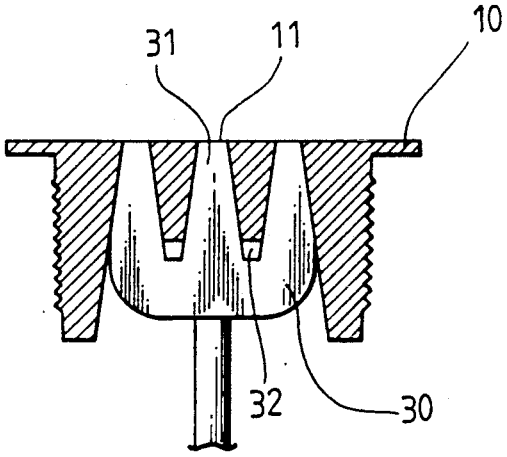
FIG. 3 is a partial cross-sectional view of the drain value of the present invention showing a plug inserted in the drain hole screen.

Referring to FIG. 3, when the plug 30 is inserted fully into the drain hole screen 10, there are small spaces 32 formed between plug 30 and drain hole screen 10. If there is small waste drained through the drain hole screen 10, it will be easy to force it to flow down when water drains through the screen.

Thus, the present invention provides a drain valve having a screen 10 which can be a filter so that no further filter has to be provided. The drain hole screen 10 is mounted in lowest portion of the lavatory 20 in order to completely drain water contained therein and to easily clean the lavatory 20. Because the plug 30 is disposed below screen 10, whether moved upward or downward, there is no obstacle formed in the lavatory when in use or being cleaned. The shape of the drain hole 10 can be modified as desire to beautify the appearance of the lavatory 20 and the drain hole screen 10. Further, there is an adjustable weight 51 arranged at the low end of the control bar 50, so that the operation force will be small. Since the plug 30 can be directly moved downward or upward, no further supporting member is necessary to be arranged in the drain pipe so that the manufacturing and assembling will be much more easier.

As various possible embodiments might be made of the above invention without departing from the scope of the invention, it is to be understood that all matter herein described or shown in the accompany drawings is to be interpreted as illustrative and not in a limiting sense. Thus, if will be appreciated that the drawings are exemplary of preferred embodiments of the invention.

I claim:

1. A drain valve assembly for a sink having a drain hole, comprising:

a drain hole screen mounted in the drain hole having an outer side facing the sink and an inner side facing oppositely to said outer side;

a plurality of tapered openings in said screen having a smaller cross-section at said outer side than at said inner side;

a plug disposed adjacent said inner side of said screen;

a plurality of tapered stems extending from said plug inserted in and substantially conforming with respective ones of said tapered holes;

a lift rod extending from said plug in a direction substantially opposite to said stems; and control bar means operatively connected to said lift rod for reciprocating said lift rod toward and away from said screen, so that operation of said control bar in a valve closing direction reciprocates said lift rod toward said screen to displace said plug and stems so that the stems are in a fully inserted position in said screen and tapered holes for closing the drain valve, and operation of said control bar in a valve opening direction reciprocates said lift rod in a direction away from said screen to displace said plug and stems in a direction away from said outer side of said screen for opening the drain valve, the amount of the displacement in said direction away from said outer side controlling the flow rate through the drain hole.

2. A drain valve assembly as claimed in claim 1 wherein:

said tapered holes are frustoconically shaped holes; and said stems are frustoconically shaped to conform with respective ones of said holes.

3. A drain valve assembly as claimed in claim 1, wherein said drain hole screen is circular-shaped.

4. A drain valve assembly as claimed in claim 1, wherein said drain hole screen is rectangular-shaped.

5. A drain valve assembly as claimed in claim 1, wherein said drain hole screen is triangular-shaped.

6. A drain valve assembly as claimed in claim 1, wherein said drain hole screen is H-shaped.

7. A drain valve assembly as claimed in claim 1, wherein said drain hole screen is S-shaped.

8. A drain valve assembly as claimed in claim 2 wherein: said holes have a circular cross-section; and said stems have a circular cross-section.

9. A drain valve assembly as claimed in claim 8, wherein said drain hole screen is circular-shaped.

10. A drain valve assembly as claimed in claim 8, wherein said drain hole screen is rectangular-shaped.

11. A drain valve assembly as claimed in claim 8, wherein said drain hole screen is triangular-shaped.

12. A drain valve assembly as claimed in claim 8, wherein said drain hole screen is H-shaped.

13. A drain valve assembly as claimed in claim 8, wherein said drain hole screen is S-shaped.

* * * * *